US005104299A

United States Patent [19]

Mizuno et al.

[11] Patent Number: 5,104,299

[45] Date of Patent: Apr. 14, 1992

[54] ELECTROMAGNETIC RECIPROCATING PUMP

[75] Inventors: Kenji Mizuno; Toshio Osada; Yutaka Tanaka, all of Tokyo, Japan

[73] Assignee: Nitto Kohki Co., Ltd., Tokyo, Japan

[21] Appl. No.: 660,849

[22] Filed: Feb. 26, 1991

[30] Foreign Application Priority Data

Mar. 5, 1990 [JP] Japan ..... 2-53462

[51] Int. Cl.[5] ..... F04B 17/04; F16H 25/18

[52] U.S. Cl. ..... 417/417; 417/418; 74/110

[58] Field of Search ..... 417/417, 418, 420; 74/110

[56] References Cited

U.S. PATENT DOCUMENTS

| | | | |
|---|---|---|---|
| 4,261,689 | 4/1981 | Takahashi | 417/417 |
| 4,752,194 | 6/1988 | Wienen et al. | 417/420 |
| 4,838,771 | 6/1989 | Kikuchi | 417/417 |
| 4,871,301 | 10/1989 | Buse | 417/420 |
| 4,924,675 | 5/1990 | Higham et al. | 417/417 |

FOREIGN PATENT DOCUMENTS

| | | |
|---|---|---|
| 2105793 | 3/1983 | United Kingdom . |
| 2165004 | 4/1986 | United Kingdom . |

*Primary Examiner*—Richard A. Bertsch

*Assistant Examiner*—Alfred Basichas

*Attorney, Agent, or Firm*—Nixon & Vanderhye

[57] ABSTRACT

An electromagnetic reciprocating pump having a piston electromagnetically moved at least in one direction is comprised of a frame having attached thereto an electromagnet which operates the piston, an inner cylinder whose one end side in the axial direction is secured to the frame and the other side thereof is closed and having the piston accommodated therein such that the piston can be reciprocated therein, an outer cylinder whose one end in the axial direction being secured to the frame and coaxially encircling the inner cylinder so as to form a working chamber between it and the inner cylinder, an outer piston accommodated within the working chamber so as to freely reciprocate and varying a capacity of working chamber, spring means being contracted and expanded in accordance with the movement of the outer piston, and magnetic coupling means for magnetically coupling the inner piston and the outer piston. The piston has a shape such that this piston does not form a pressure in the inner cylinder when reciprocated within the first cylinder. Further, the outer cylinder has a suction opening and a discharge opening, each having a valve, for sucking and discharging a special fluid, such as corrosive liquid, into and from the working chamber.

10 Claims, 2 Drawing Sheets

ELECTROMAGNETIC RECIPROCATING PUMP

BACKGROUND OF THE INVENTION

1. Field of the Invention

The present invention generally relates to electromagnetic reciprocating pumps and, more particularly, is directed to a closed type electromagnetic reciprocating pump for use in suction and discharge of solvent, chemical and so on.

2. Description of the Related Art

As described, for example, in Published Examined Japanese Patent Application No. 57-30984, a fundamental arrangement of conventional electromagnetic reciprocating pump is known. This conventional electromagnetic reciprocating pump is composed of a piston which is reciprocated by an alternate action of a magnetic action and a spring action and a cylinder which defines a working chamber together with the piston, and a suction opening and a discharge opening are provided on the cylinder or the suction opening is provided on the piston and the discharge opening is provided on the cylinder.

The conventional electromagnetic reciprocating pump is suitably applied to gas and cannot be used for pumping liquid without difficulty from a configuration standpoint. Further, since the conventional electromagnetic reciprocating pump is arranged such that the piston is brought in direct contact with fluid, the conventional electromagnetic reciprocating pump cannot be applied to corrosive fluid irrespective of gas and liquid without difficulty. There is then the problem that the application range of this electromagnetic reciprocating pump to a wide variety of fluids cannot be extended.

SUMMARY OF THE INVENTION

Accordingly, it is an object of the present invention to provide an improved electromagnetic reciprocating pump which can eliminate the aforementioned shortcomings and disadvantages encountered with the prior art.

More specifically, it is an object of the present invention to provide an electromagnetic reciprocating pump which can be applied to solvent, chemical and a wide variety of fluids involving corrosive gas and liquid.

According to an aspect of the present invention, an electromagnetic reciprocating pump having a piston electromagnetically moved at least in one direction is comprised of a frame having attached thereto an electromagnetic circuit which operates the piston, a first cylinder whose one end in the axial direction is secured to the frame and the other end thereof is closed and having the piston accommodated therein such that the piston can be reciprocated therein, the piston being shaped so as not to form a pressure within the first cylinder when the piston is reciprocated within the first cylinder, a second cylinder whose one end in the axial direction being secured to the frame and coaxially encircling the first cylinder so as to form a working chamber between it and the first cylinder, an additional piston accommodated within the working chamber for sucking and discharging a fluid, a suction opening and a discharge opening provided in the second cylinder, each having a valve, and communicating the working chamber to the outside through its value, spring means being alternatively contracted and expanded in accordance with the movement of the another piston, and magnetic coupling means for magnetically coupling the piston and the additional piston in the radial thereof.

In the electromagnetic reciprocating pump according to this invention, two pistons are perfectly isolated by the first cylinder and also placed in a coupled state by the magnetic coupling means so that, when the piston in the first cylinder is reciprocated by the magnetic action or by the alternate action of the magnetic action and the spring action, another piston is reciprocated following the movement of the piston within the first cylinder due to the attracting action of the permanent magnets, thereby the fluid being absorbed and discharged alternatively from the suction opening and the discharge opening provided in the second cylinder.

As described above, in the electromagnetic reciprocating pump of the present invention, since the fluid working chamber is completely isolated by two cylinders without providing a seal mechanism, the fluid can be completely prevented from being flowed to the driving portion side of the piston which is the driving source, and this electromagnetic reciprocating pump can be applied to any fluid such as gas and liquid. Accordingly, this electromagnetic reciprocating pump is very useful in the application to a vacuum pump of, for example, a solvent collecting apparatus or when gas containing solvent is absorbed. Therefore, this electromagnetic reciprocating pump achieves a great advantage such that the application range of the pump to a variety of fluids can be considerably enlarged. Further, when fluid containing corrosive property is absorbed and discharged, the whole of the pump need not be made of corrosion resisting material, thus contributing to a great reduction of a manufacturing cost.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

The accompanying drawings show the preferred embodiment of the present invention in which.

DETAILED DESCRIPTION OF THE PREFERRED EMBODIMENTS

An electromagnetic reciprocating pump according to an embodiment of the present invention will hereinafter be described with reference to FIGS. 1 and 2.

Figure 1:
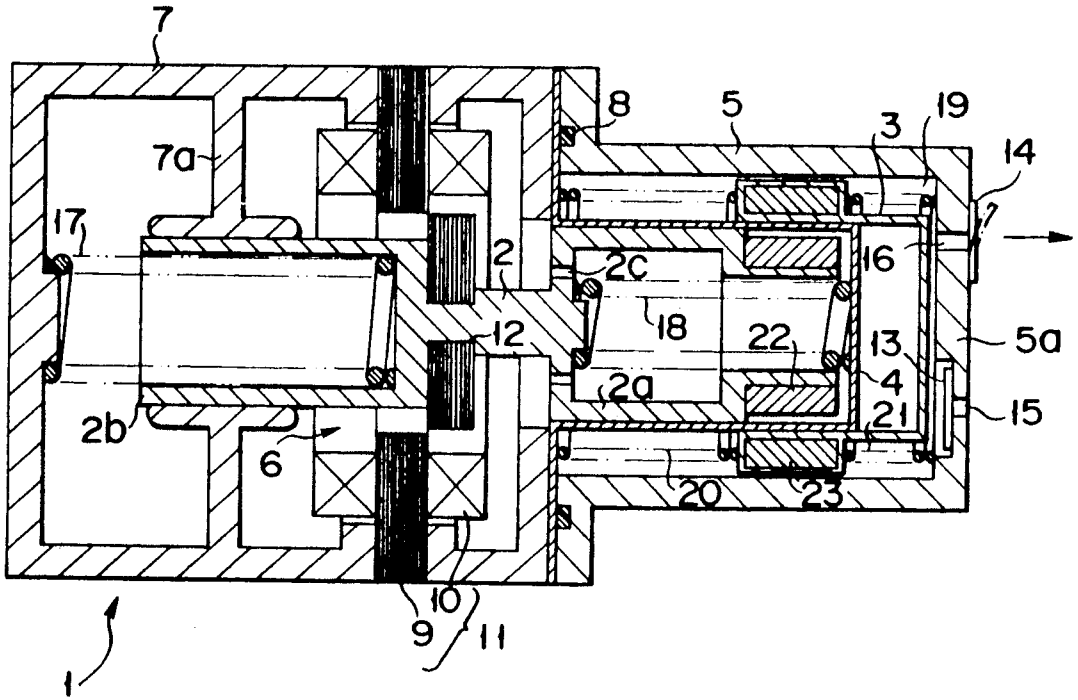
FIG. 1 is a diagrammatic view of a section of an electromagnetic reciprocating pump and illustrating the condition such that an electromagnet is in a demagnetized state; an FIG. 2 is a diagrammatic view of a section of the electromagnetic reciprocating pump and illustrating the condition such that the electromagnet is in an excited state.
Figure 2:
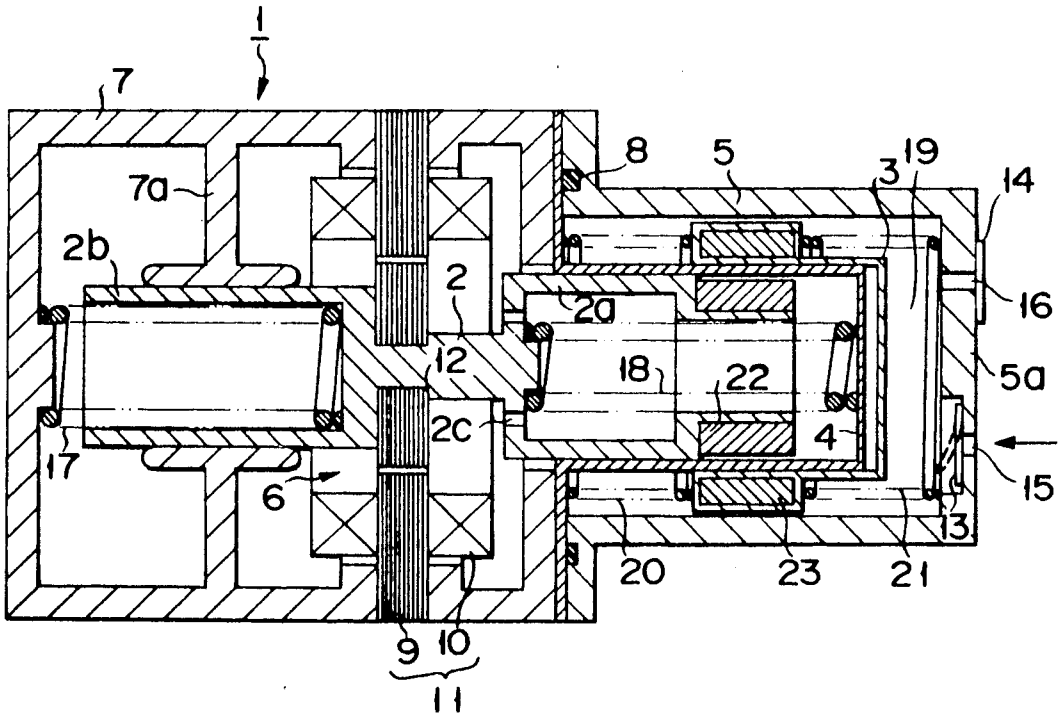

It will be seen in FIG. 1 that an electromagnetic reciprocating pump 1 is composed of an inner piston 2 which is reciprocated in the axial direction thereof and an outer piston 3 which can be reciprocated in the same direction as that of the inner piston 2. The inner piston 2 is housed in a first cylinder 4 and the outer piston 3 is housed within a second cylinder 5 coaxially provided outside the first cylinder 4 while the inner and outer peripheral surfaces of the outer piston 3 are brought in slidable contact with the first and second cylinders 4 and 5. These first and second cylinders 4 and 5 are hermetically secured through a seal ring 8 to the front wall portion of a frame 7 in which a magnetic circuit 6 to drive the inner piston 2 is provided.

Within the frame 7 provided is an electromagnet 11 which is formed by winding a coil 10 around a field core 9. An electromagnet armature 12 is provided at the central portion of the inner piston 2, and the electromagnet 11, the electromagnetic armature 12 and a control circuit (not shown) and so on constitute the magnetic circuit 6.

The first cylinder 4 is made thin so as not to decrease magnetic permeability and is shaped as a cylinder having a bottom by a non-magnetic material such as a stainless steel or the like. On the other hand, the second cylinder 5 has a head portion 5*a* in which a suction opening 15 and a discharge opening 16 having separately valves 13 and 14 are provided.

The inner piston 2 is composed of front and rear pistons 2*a* and 2*b* and the electromagnetic armature provided at the central portion thereof. The front piston 2*a* is inserted into the first cylinder 4 and the rear cylinder 2*b* is inserted into a cylinder portion 7*a* within the frame 7. In the inner piston 2, a coil spring 17 is interposed between the rear piston 2*b* and the rear portion of the frame 7 and an auxiliary spring 18 having a spring force smaller than that of the coil spring 17 is interposed between the front piston 2*a* and the first cylinder 4. As a consequence, the inner piston 2 is located on the axis of the frame 7 and when the pump is not in its operable state, the electromagnetic armature 12 is slightly deviated (state of FIG. 1) toward the first cylinder 4 side from the field core 9. Incidentally, a small opening 2*c* is bored through the front piston 2*a* so that the inside of the first cylinder 4 is not hermetically closed.

On the other hand, the outer piston 3 is shaped as a cup configuration so as to fully cover the outer peripheral portion of the distal end portion of the first cylinder 4 and forms between it and the second cylinder 5 a working chamber 19 whose volume increases and decreases in accordance with the reciprocation of the outer piston 3. On the outer piston 3, resonance springs 20 and 21 are provided along its axial direction in order to make the reciprocation more smooth.

Permanent magnets 22 and 23 are separately provided in the inner and outer pistons 2 and 3 so as to sandwich the first cylinder 4 from the inner and outer peripheral directions in an opposing fashion. While the inner and outer pistons 2 and 3 are completely isolated from each other by the first cylinder 4, they are constantly kept in the coupled state by the two permanent magnets 22 and 23.

An action of the above-mentioned embodiment will be described below.

In the magnetic circuit 6, an input AC voltage is half-wave rectified by a control circuit (not shown), whereby the electromagnet 11 is conducted intermittently and cyclically. When the electromagnet 11 is energized by this application of the voltage, as shown in FIG. 2, the electromagnetic armature 12 is attracted and simultaneously by the spring-force action of the auxiliary spring 18, the inner piston 2 is reciprocated in the axial direction while contracting the coil spring 17. At that time, the outer piston 3 is reciprocated by the permanent magnets 22 and 23 which are attracted to each other across the first cylinder 4 in accordance with the inner piston 2, thereby the volume of the working chamber 19 being increased. Therefore, as shown by a phantom in FIG. 1, the suction valve 13 is opened to cause the fluid to be flowed from the suction opening 15 into the working chamber 19.

When the supply of the voltage to the electromagnet 11 is stopped and the electromagnet 11 is deenergized, the inner piston 2 is reciprocated by a repulsive force of the coil spring 17. In accordance with the reciprocation of the inner piston 2, the outer piston 3 also is reciprocated to reduce the volume of the working chamber 19 so that, as shown by a phantom in FIG. 1, the discharge valve 14 is opened to discharge the fluid within the working chamber 19 from the discharge opening 16. The above-mentioned operation is repeated to cause the fluid to be sent to a desired supply object (a fluid consuming device).

In the electromagnetic reciprocating pump 1 which is operated as described above, the working chamber 19 becomes completely isolated from the magnetic circuit 6 and the inner piston 2 which acts as the driving source to thereby permit the fluid to flow therethrough, and strictly speaking, the fluid is circulated only into the space formed between the first cylinder 4 and the second cylinder 5. Accordingly, this electromagnetic reciprocating pump 1 can be applied to any one of gas and liquid. For example, even when these fluids are corrosive ones, it is sufficient that the first and second cylinders 4 and 5 forming the working chamber 19 and respective assembly parts such as the outer piston 3 and so on may be made of anti-corrosive material.

Having described a preferred embodiment of the invention with reference to the accompanying drawings, it is to be understood that the invention is not limited to that precise embodiment and that various changes and modifications thereof could be effected by one skilled in the art without departing from the spirit or scope of the invention as defined in the appended claims.

What is claimed is:

1. An electromagnetic reciprocating pump having a piston electromagnetically moved at least in one direction, comprising:

a frame mounting an electromagnetic circuit which operates said piston;

a first cylinder whose one end in the axial direction is secured to said frame and the other end thereof is closed and having said piston accommodated therein such that said piston can be reciprocated therein, said piston being shaped so as not to form a pressure within said first cylinder when said piston is reciprocated within said first cylinder;

a second cylinder whose one end in the axial direction being secured to said frame and coaxially encircling said first cylinder so as to form a working chamber between it and said first cylinder;

an additional piston reciprocatively received within said working chamber for sucking and discharging a fluid;

a suction opening and a discharge opening provided in said second cylinder, each having a valve and communicating said working chamber to the outside through it value;

spring means being alternatively contracted and expanded in accordance with the movement of said another piston; and magnetic coupling means for magnetically coupling said piston and said other piston in the radial direction thereof.

2. An electromagnetic reciprocating pump according to claim 1, in which said first cylinder is made of a non-magnetic material, said additional piston has a cup-configuration housing therein the other end of said first cylinder and said magnetic coupling means include a pair of permanent magnets, one of which is attached to said piston, other of which is attached to said additional piston and said pair of permanent magnets being opposed to each other across said first cylinder.

3. An electromagnetic reciprocating pump according to claim 2, in which said magnetic circuit composes a core member secured to said frame and having at least a pair of magnetic poles symmetrically arranged at a central portion thereof, a coil wound around said core member and an electromagnetic armature secured to said piston and movable between said magnetic poles in the axial direction.

4. An electromagnetic reciprocating pump according to claim 3, in which said piston composes a front portion having an opening at both ends in the axial direction and guided within said first cylinder in the axial direction, a rear portion guided within said frame in the axial direction and an intermediate portion provided with said electromagnetic armature.

5. An electromagnetic reciprocating pump according to claim 3, wherein said piston comprises a return spring to return said electromagnetic armature into its original position relative to said core member, and an auxiliary spring for urging said piston in the opposite direction by a spring force smaller than that of said return spring.

6. An electromagnetic reciprocating pump according to claim 1, further comprising spring means including a pair of coil springs which urge said first cylinder to place said pair of permanent magnets in a radially closest position when said magnetic circuit is not energized.

7. An electromagnetic reciprocating pump according to claim 2, further comprising spring means including a pair of coil springs which urge said first cylinder to place said pair of permanent magnets in a radially closest position when said magnetic circuit is not energized.

8. An electromagnetic reciprocating pump according to claim 3, further comprising spring means including a pair of coil springs which urge said first cylinder to place said pair of permanent magnets in a radially closest position when said magnetic circuit is not energized.

9. An electromagnetic reciprocating pump according to claim 4, further comprising spring means including a pair of coil springs which urge said first cylinder to place said pair of permanent magnets in a radially closest position when said magnetic circuit is not energized.

10. An electromagnetic reciprocating pump according to claim 5, further comprising spring means including a pair of coil springs which urge said first cylinder to place said pair of permanent magnets in a radially closest position when said magnetic circuit is no energized.

* * * * *